US011851248B2

(12) United States Patent
Miyama et al.

(10) Patent No.: US 11,851,248 B2
(45) Date of Patent: Dec. 26, 2023

(54) EASILY OPENABLE CONTAINER LID

(71) Applicant: NIPPON CLOSURES CO., LTD., Tokyo (JP)

(72) Inventors: Yuki Miyama, Kanagawa (JP); Katsuhito Ichimura, Kanagawa (JP)

(73) Assignee: NIPPON CLOSURES CO., LTD., Tokyo (JP)

( * ) Notice: Subject to any disclaimer, the term of this patent is extended or adjusted under 35 U.S.C. 154(b) by 0 days.

(21) Appl. No.: 17/773,975

(22) PCT Filed: Nov. 9, 2020

(86) PCT No.: PCT/JP2020/041663
§ 371 (c)(1),
(2) Date: May 3, 2022

(87) PCT Pub. No.: WO2021/111811
PCT Pub. Date: Jun. 10, 2021

(65) Prior Publication Data

US 2022/0371786 A1 Nov. 24, 2022

(30) Foreign Application Priority Data

Dec. 5, 2019 (JP) ..... 2019-220084

(51) Int. Cl.
*B65D 41/42* (2006.01)
*B65D 53/04* (2006.01)

(52) U.S. Cl.
CPC ..... *B65D 41/425* (2013.01); *B65D 53/04* (2013.01); *B65D 2251/0015* (2013.01);
(Continued)

(58) Field of Classification Search
CPC ..... B65D 41/425; B65D 53/04; B65D 2251/0015; B65D 2251/0093; B65D 2251/02; B65D 2251/205
(Continued)

(56) References Cited

U.S. PATENT DOCUMENTS 2,068,444 A * 1/1937 Breckenridge ..... B65D 51/243 215/257
4,003,488 A * 1/1977 Moller ..... B65D 41/42 215/254
(Continued)

FOREIGN PATENT DOCUMENTS

JP 62-168863 7/1987
JP 63-111446 7/1988
(Continued)

OTHER PUBLICATIONS

International Search Report dated Dec. 28, 2020 in International (PCT) Application No. PCT/JP2020/041663.

*Primary Examiner* — J. Gregory Pickett
*Assistant Examiner* — Niki M Eloshway
(74) *Attorney, Agent, or Firm* — WENDEROTH, LIND & PONACK, L.L.P.

(57) ABSTRACT

An easily openable container lid includes a shell and liner. The shell includes a flat circular top wall, a skirt wall having an arcuate part extending arcuately radially outward and downward from the peripheral edge of the top wall in a longitudinal cross sectional view and a linear part extending vertically downward following the arcuate part, and a grip piece extending from the lower end of the skirt wall. The top wall, the skirt wall and at least a base part of the grip piece are integrally formed of a metal sheet, and a pair of scores each composed of first and second portions are formed on the shell. The first portions extend on the skirt wall upward from both sides of the grip piece, and the second portions extend arcuately between the upper end part of the skirt part and the peripheral edge part of the top wall.

19 Claims, 4 Drawing Sheets

(52) U.S. Cl.
CPC .. *B65D 2251/0093* (2013.01); *B65D 2251/02* (2013.01); *B65D 2251/205* (2013.01)

(58) Field of Classification Search
USPC ..... 215/305
See application file for complete search history.

(56) References Cited

U.S. PATENT DOCUMENTS

| | | | | |
|---|---|---|---|---|
| 10,954,040 | B2 * | 3/2021 | Lo Piccolo | B65D 53/04 |
| 2006/0043053 | A1 * | 3/2006 | Herald | B65D 41/485 215/253 |
| 2016/0207671 | A1 * | 7/2016 | Okubo | B65D 43/26 |
| 2021/0016933 | A1 * | 1/2021 | Cepa | B65D 53/04 |

FOREIGN PATENT DOCUMENTS

| | | | | |
|---|---|---|---|---|
| JP | 1-111666 | | 4/1989 | |
| JP | 08-119301 | | 5/1996 | |
| JP | 10-24955 | | 1/1998 | |
| JP | 11-115937 | | 4/1999 | |
| JP | 2008-174266 | | 7/2008 | |
| JP | 2011-051595 | | 3/2011 | |
| JP | 2011-173594 | | 9/2011 | |
| JP | 2015-40060 | | 3/2015 | |
| JP | 2021088393 | A * | 6/2021 | B65D 41/425 |
| WO | WO-2015025737 | A1 * | 2/2015 | B65D 41/32 |

* cited by examiner

EASILY OPENABLE CONTAINER LID

TECHNICAL FIELD

The present invention relates to an easily openable container lid for a container that has a cylindrical mouth-neck section having an annular locking ridge formed at the upper end part of its outer peripheral surface, and the mouth-neck section is sealed after a gas-containing liquid is accommodated within the container so that the interior of the container has a positive internal pressure.

BACKGROUND ART

Patent Documents 1-3 below disclose an easily openable container lid for a container that has a cylindrical mouth-neck section having an annular locking ridge formed at the upper end part of the outer peripheral surface. The mouth-neck section thereof is to be sealed such that the container has a positive internal pressure after a gas-containing liquid is accommodated within the container. The container lid comprises a shell and a liner. The shell comprises a flat circular top panel wall, a skirt wall having an arcuate part extending arcuately radially outward and downward from the peripheral edge of the top panel wall in a longitudinal cross sectional view and a linear part extending vertically downward to follow the arcuate part, and a grip piece extending from the lower end of the skirt wall. The top panel wall, the skirt wall and at least a base part of the grip piece are integrally formed of a metal sheet. The liner, which is disc-shape and made of a synthetic resin, is disposed on the inner surface of the top panel wall of the shell. On the shell, a pair of scores each composed of a first portion and a second portion are formed. The first portions extend on the skirt wall upward from the both sides of the grip piece and each arcuately in the circumferential direction, and the second portions extend arcuately between the upper end part of the skirt wall and the peripheral edge part of the top panel wall.

The container lid is attached to the mouth-neck section of the container by fitting to the mouth-neck section and by pressing the liner against the mouth-neck section so that the lower part of the linear part of the skirt wall is swaged radially inward below the locking ridge of the mouth-neck section. At the time of unsealing the mouth-neck section, the container lid is detached from the mouth-neck section by grasping and pulling the grip piece radially outward and then upward to gradually rupture the pair of scores.

PRIOR ART DOCUMENTS

Patent Documents

[Patent Document 1] JP 2008-174266 A
[Patent Document 2] JP 2011-173594 A
[Patent Document 3] JP 2015-40060 A

SUMMARY OF THE INVENTION

Problem to be Solved by the Invention

However, the present inventors have found from their experiences the following problems of the aforementioned conventional container lids. That is, in a case where in particular, a container equipped with the container lid and sealed at the mouth-neck section is exposed to a high temperature under the scorching sun for instance, the pressure inside the container increases significantly. When the container lid is detached from the mouth-neck section to unseal the mouth-neck section, there may be a risk that the container lid flies/drops off vigorously from the mouth-neck section with the release of the high pressure inside the container.

For solving the problems, the present invention aims to provide a novel and improved container lid. According to the present invention, a main object from the technical viewpoint is to provide a container lid that will not fly/drop off vigorously from the mouth-neck section at the time of detaching the container lid from the mouth-neck section even if the pressure inside the container increases considerably, and the container lid will not substantially cause any other problems or demand any excessive force at the detachment of the container lid from the mouth-neck section.

Means for Solving the Problems

As a result of keen studies, the present inventors have found that the main object in the technical field can be achieved by modifying the extension of the first portions of the pair of scores such that the first portions would extend straight from the lower end of the skirt wall to the site above the upper end of the lower part at which the linear part would be swaged.

That is, the present invention provides an easily openable container lid to achieve the aforementioned main technical objects, which is an easily openable container lid for a container that has a cylindrical mouth-neck section having an annular locking ridge formed at the upper end part of the outer peripheral surface, the mouth-neck section is to be sealed to have a positive internal pressure after a gas-containing liquid is accommodated within the container,

- the container lid comprises a shell and a liner,
- the shell comprises a flat circular top panel wall, a skirt wall having an arcuate part extending arcuately radially outward and downward from the peripheral edge of the top panel wall in a longitudinal cross sectional view and a linear part extending vertically downward to follow the arcuate part, and a grip piece extending from the lower end of the skirt wall,
- the top panel wall, the skirt wall and at least a base part of the grip piece are integrally formed of a metal sheet, and a pair of scores each composed of a first portion and a second portion are formed, where the first portions extend upward on the skirt wall from the both sides of the grip piece, and the second portions extend arcuately between the upper end part of the skirt part and the peripheral edge part of the top panel wall,
- the liner, which is disc-shape and made of a synthetic resin, is disposed on the inner surface of the shell,
- the container lid is attached to the mouth-neck section by swaging the lower part of the linear part of the skirt wall radially inward below the locking ridge of the mouth-neck section, wherein
- the respective first portions of the pair of scores extend straight from the lower end of the skirt wall to a site above the upper end of the lower part of the linear part.

Preferably, the respective first portions of the pair of scores extend vertically from the lower end of the skirt wall to a site above the upper end of the lower part of the linear part. It is suitable that the first portions of the pair of scores extend straight to the upper end of the linear part of the skirt wall, and extend upward and arcuately in a direction to a direction to be circumferentially spaced from each other at the arcuate part of the skirt wall. It is preferred that the liner is non-adhesive or weakly adhesive to the shell in a pair of arcuate regions extending on the pair of scores and covering the pair of scores while the liner is adhered to the shell in regions other than the pair of arcuate regions. Suitably, the liner has a thin-walled centration section and a thick-walled peripheral edge section, the thick-walled peripheral edge section has a lower surface on which an internal annular sealant and an external annular sealant both extending concentrically downward are formed, and the lower end of the external annular sealant is positioned above the upper end of the linear part of the skirt wall. Preferably, the lower end of the external annular sealant is positioned as high as the vertically intermediate site of the arcuate part of the skirt wall. It is preferable that the lower end of the internal annular sealant is positioned below the lower end of the external annular sealant and above the upper end of the linear part of the skirt wall.

Effects of the Invention

In detaching a container lid from a mouth-neck section of a container, usually the internal pressure is released at around the moment the respective first portions of the pair of scores are ruptured from the lower end of the skirt wall to the upper end of the lower part at which the linear part of the skirt wall is swaged. As for the container lid of the present invention, the respective first portions of the pair of scores extend straight from the lower end of the skirt wall to the upper end of the lower part at which the linear part is to be swaged. Therefore, at the releasing of the container inner pressure, it is possible to increase the circumferential length of the region at which the swaged state is not released but maintained at the linear part of the skirt wall in comparison with a case of a conventional container lid. This will serve to prevent the container lid from flying/dropping off vigorously at detaching the container lid from the mouth-neck section. Meanwhile, the site of each of the first portions of the pair of scores, which ranges from the lower end of the skirt wall in the first portion to the upper end of the swaged lower part of the linear part of the skirt wall, is the part to be ruptured at the initial stage of the rupture of the pair of scores. Since this part extends straight, it requires less force at the initial stage of starting the rupture of the pair of scores in comparison to a case where the parts to be ruptured extend arcuately to the circumferential both sides upward (i.e., to the direction to be spaced circumferentially from each other). As a result, any excessive force is not required for detaching the container lid from the mouth-neck section. The required force will be rather smaller than a case of a conventional lid.

MODE FOR CARRYING OUT THE INVENTION

A preferred embodiment of a container lid configured in accordance with the present invention will now be described in further detail with reference to the attached drawings.

Figure 1:
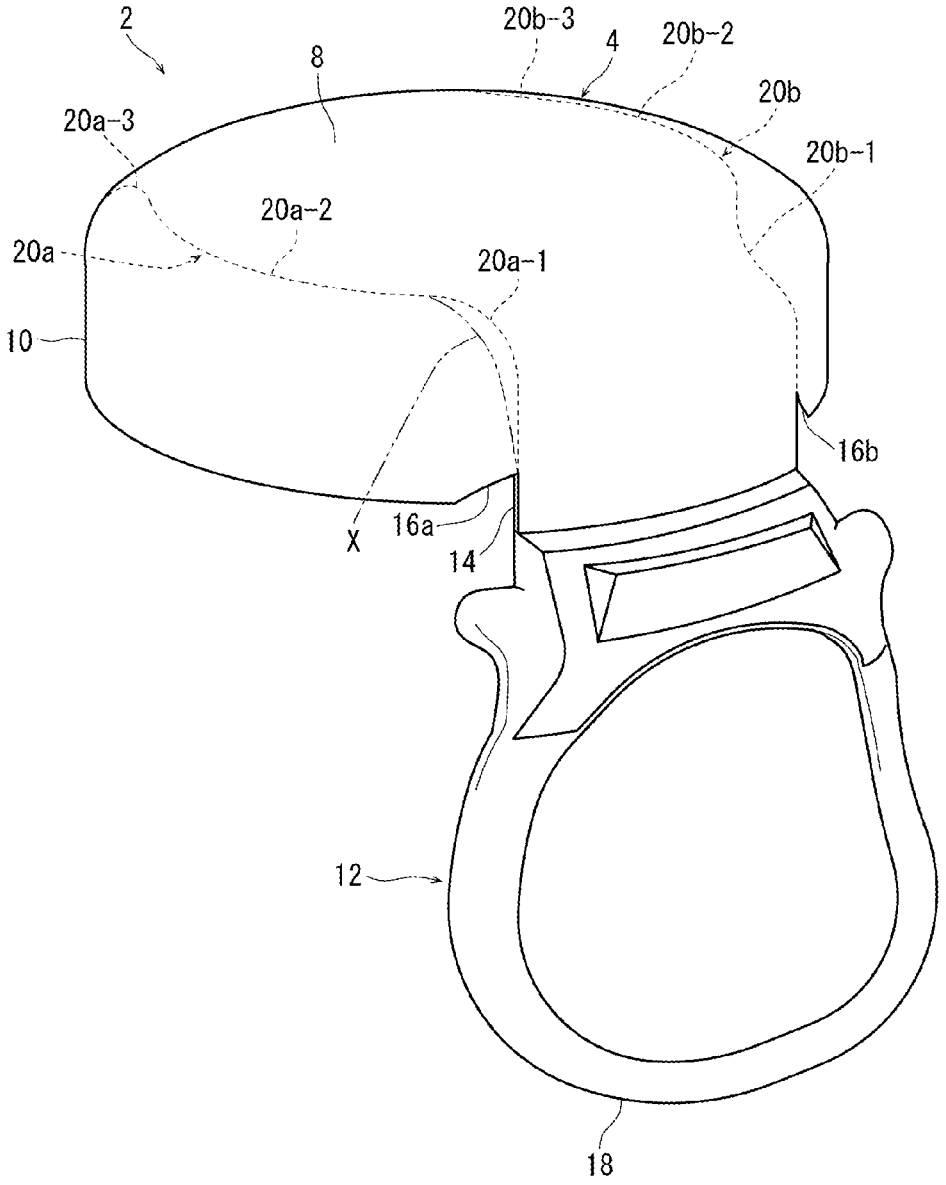
FIG. 1 is a perspective view showing a suitable embodiment of container lid configured according to the present invention.
Figure 2:
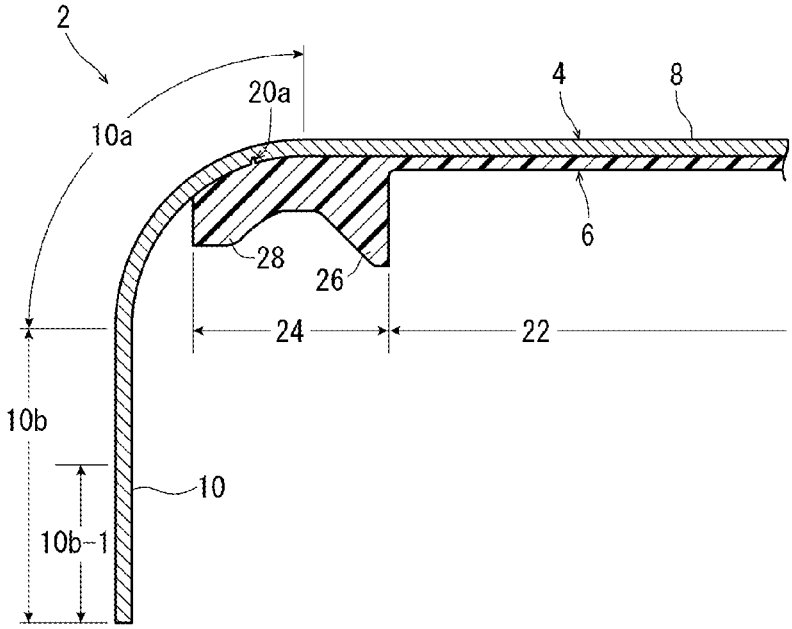
FIG. 2 is a cross sectional view partly showing the container lid of FIG. 1.

The following explanation is made referring to FIGS. 1 and 2. A container lid indicated with a numeral 2 consists of a shell 4 and a liner 6 (see FIG. 2).

The shell 4 comprises a circular top panel wall 8, a cylindrical skirt wall 10 hanging down from the peripheral edge of the top panel wall 8, and a grip piece 12 extending from the lower end of the skirt wall 10. As clearly understandable by referring to FIG. 2, the skirt wall 10 has an arcuate part 10*a* that extends arcuately radially outward and downward from the peripheral edge of the top panel wall 8 and a linear part 10*b* that extends vertically downward to follow the arcuate part 10*a* in the longitudinal cross sectional view of FIG. 2. As will be explained later more in detail, in attaching the container lid 2 to the mouth-neck section 32 (see FIG. 5) of the container, a lower part 10*b*-1 of the linear part 10*b* of the skirt wall 10 is deformed radially inward to be swaged to the annular locking ridge 34 (see FIG. 5) of the mouth-neck section 32. The base part 14 of the grip piece 12 (see also FIG. 3) is formed integrally with the top panel wall 8 and the skirt wall 10 through suitable machining works like punching and drawing to suitable metal sheets such as an aluminum-based alloy sheet, a chromic acid treated steel sheet or a tin sheet. Notches 16*a* and 16*b* are formed at the lower end part of the skirt wall 10, specifically at the both sides of the base part 14 of the grip piece 12. The grip piece 12 consists of the base part 14 and a ring part 18 linked thereto. The ring part 18 of the grip piece 12 is formed by injection-shaping or compression-shaping any suitable synthetic resin material like polypropylene or polyethylene, using as a core the base part 14 of the grip piece 12, so that the ring portion 18 can be linked to the base portion 14 at the same time of the formation. If necessary, it is also possible to integrally form the entire grip piece 12, the top panel wall 8 and the skirt wall 10, from a metal sheet.

A pair of scores 20*a* and 20*b* are formed on the shell 4, or more specifically, on the areas integrally formed from the metal sheet. The pair of scores 20*a* and 20*b* are favorably formed by working the metal sheet from its back surface with a tool for decreasing the thickness of the metal sheet. The scores 20*a* and 20*b* comprise first portions 20*a*-1 and 20*b*-1 and further, second portions 20*a*-2 and 20*b*-2. The first portions 20*a*-1 and 20*b*-1 extend upward on the skirt wall 10 from the lower end of the skirt wall 10, more specifically, from the notches 16*a* and 16*b* formed on the both sides of the grip piece 12. The second portions 20*a*-2 and 20*b*-2 following respectively the first portions 20*a*-1 and 20*b*-1 extend arcuately between the upper end part of the skirt wall 10 and the peripheral edge part of the top panel wall 8. In the illustrated embodiment, the second portions 20*a*-2 and 20*b*-2 extend on the peripheral edge part of the top panel wall 8. In the illustrated embodiment, third portions 20*a*-3 and 20*b*-3 are additionally formed (see also FIG. 3). The third portions 20*a*-3 and 20*b*-3 that follow the second portions 20*a*-2 and 20*b*-2 extend to the skirt wall 10.

Figure 3:
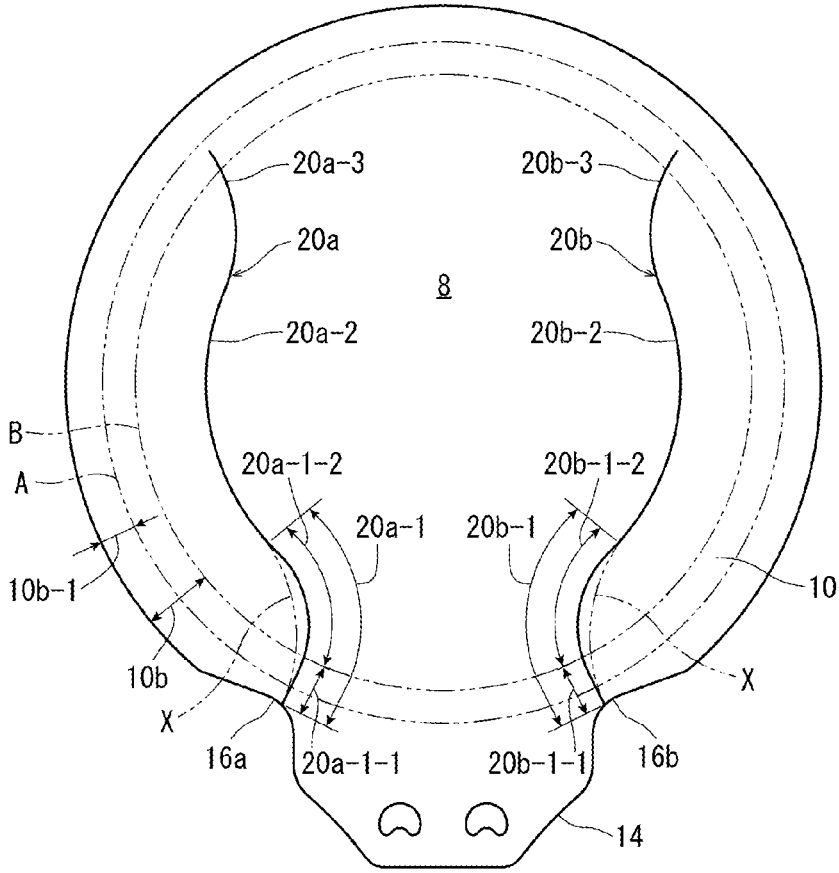
FIG. 3 is a developed view showing an example of a pair of scores in the container lid of FIG. 1.

FIG. 3 shows a metal sheet to make the top panel wall 8, the skirt wall 10 and the base part 14 of the grip piece 12 of the shell 4. The metal sheet in FIG. 3 has been punched to make the respective parts but not yet drawn. In other words, FIG. 3 shows one surface of the metal sheet that defines the inner surfaces of the top panel wall 8 and the skirt wall 10 in the state where the base part 14 of the grip piece 12 with the top panel wall 8 and the skirt wall 10 of the shell 4 is expanded in a plane. The pair of scores 20*a* and 20*b* can be formed suitably by forming grooves on the plane for defining the inner surfaces of the top panel wall 8 and the skirt wall 10 (the surfaces shown in FIG. 3) thereby decreasing the material thickness at the same time of punching the metal sheet to a desired shape, or before drawing the metal sheet before/after the punching. Alternatively, it is possible to form the scores 20*a* and 20*b* by forming grooves on the plane to define the outer surfaces of the top panel wall 8 and the skirt wall 10, thereby decreasing the material thickness. However, this can cause rupture at the pair of scores 20*a* and 20*b*, in particular at sites where the arcuate part 10*a* of the skirt wall 10 extends during the drawing of the metal sheet. In the pair of scores 20*a* and 20*b*, t1 denotes a material residual thickness at a site of the first portions 20*a*-1 and 20*b*-1, ranging from the lower end of the skirt wall 10 of the first portions 20*a*-1 and 20*b*-1, above the upper end of the lower part 10*b*-1 of the linear part 10*b* of the skirt wall 10, and to the intermediate part of the linear part other than the lower part 10*b*-1; t2 denotes a material residual thickness at the rest of the first portions 20*a*-1 and 20*b*-1 (i.e., the site other than the site ranging from the lower end of the skirt wall 10 to the intermediate part of the linear part other than the lower part 10*b*-1 of the linear part 10*b* of the skirt wall 10 through the upper end of the lower part 10*b*-1, and also a site positioned at the arcuate part 10*a* of the skirt wall 10); and t3 denotes a material residual thickness at the second portions 20*a*-2 and 20*b*-2, and at the third portions 20*a*-3 and 20*b*-3. Preferably, the value of t1 is comparatively large, t2 is a median, and t3 is comparatively small. For instance, in a case where the metal sheet is of an aluminum-based alloy having a thickness of 0.24 mm, suitably t1 is in a range of about 170 to about 190 μm, t2 is in a range of about 155 to about 175 μm, and t3 is in a range of about 110 to about 130 μm.

The following explanation is made referring to FIG. 3 together with FIGS. 1 and 2. It is important that the first portions 20*a*-1 and 20*b*-1 in the pair of scores 20*a* and 20*b* extend straight and preferably vertically (namely, parallel to the central axis of the container 2) from the lower end of the skirt wall 10 to the site above the upper end of the lower part 10*b*-1 of the linear part 10*b* (in FIG. 3, the upper end is indicated with a long dashed double-short dashed line A). In the illustrated embodiment, the first portions 20*a*-1 and 20*b*-1 of the pair of scores 20*a* and 20*b* extend straight and vertically from the lower end of the skirt wall 10 to the upper end of the linear part 10*b* (in FIG. 3, the upper end is indicated with a long dashed double-short dashed line B). In FIG. 3, this area is indicated with signs 20*a*-1-1 and 20*b*-1-1. On the arcuate part 10*a* of the skirt wall 10, the first portions 20*a*-1 and 20*b*-1 of the pair of scores 20*a* and 20*b* extend arcuately and upward circumferentially to the both sides (which is the area indicated with reference signs 20*a*-1-2 and 20*b*-1-2 in FIG. 3).

The following explanation is made referring to FIG. 2. The liner 6 in this embodiment is formed by applying a suitable synthetic resin material like a soft polyethylene onto the inner surface of the top panel wall 8 of the shell 4, and by embossing the synthetic resin material to have a desired shape. The liner 6 has a disk shape as a whole, and it has a comparatively thin-walled centration section 22 and a comparatively thick-walled peripheral edge section 24. At the thick-walled peripheral edge section 24, an internal annular sealant 26 and an external annular sealant 28 both concentrically hanging down are formed. The experiments by the present inventors shows that preferably the lower end of the external annular sealant 28 is positioned above the upper end of the linear part 10*b* of the skirt wall 10 so that the inner pressure of the container can be released at a relatively early stage in detaching the container lid 2 from the mouth-neck section 30 (see FIG. 5) of the container, and more preferably, it is as high as the vertically intermediate site of the arcuate part 10*a* of the skirt wall 10. It is also possible that the lower end of the internal annular sealant 26 is positioned below the lower end of the external annular sealant 28 and above the upper end of the linear part 10*b* of the skirt wall 10.

Figure 4:
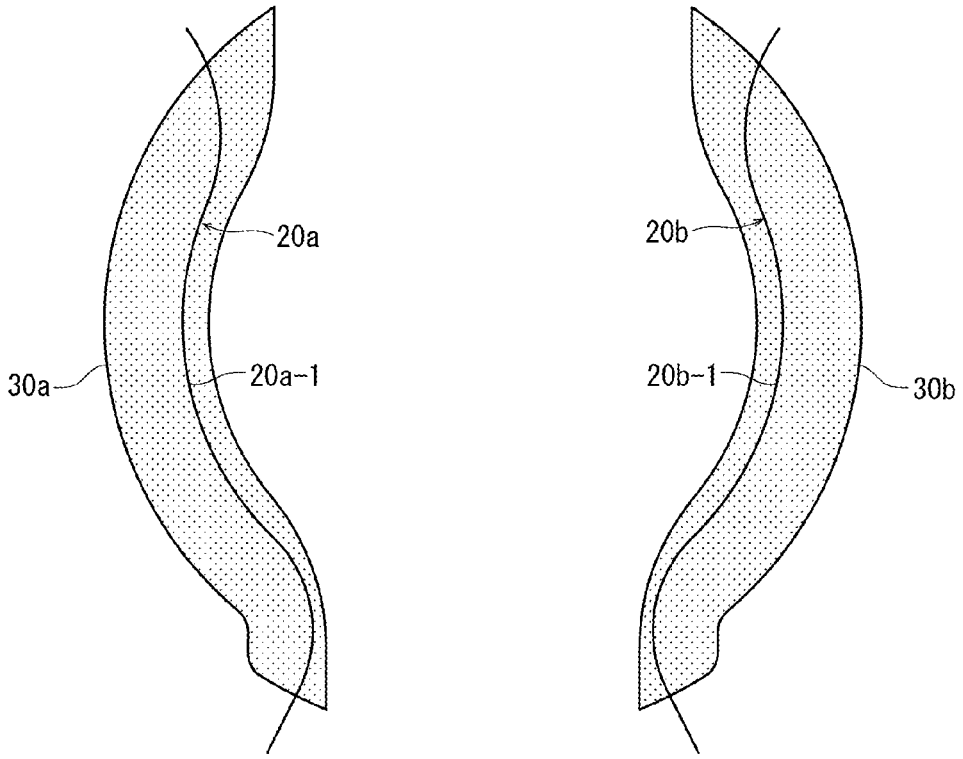
FIG. 4 is a developed view for showing the relation between a liner and a top panel wall of a shell in the container lid of FIG. 1.

FIG. 4 schematically shows the relation between the inner surface of the top panel wall 8 and the liner 6. In the illustrated embodiment, an adhesive paint for adhering to the liner 6 is applied on the entire inner surface that defines the inner surface of the top panel wall 8 (one of the surfaces of the metal sheet for forming the base part 14 of the grip piece 12 integrally with the top panel wall 8 and the skirt wall 10 of the shell 4). In FIG. 4, areas stippled at a high-density indicate the regions applied additionally with a non-adhesive or weakly adhesive paint for adhering to the liner 6. It will be understandable by referring to FIG. 2 together with FIG. 4 that the non-adhesive or weakly adhesive paint is applied to a pair of arcuate regions 30*a* and 30*b*. These arcuate regions 30*a* and 30*b* are present along the second portions 20*a*-2 and 20*b*-2 of the pair of scores 20*a* and 20*b*, and cover the second portions 20*a*-2 and 20*b*-2 of the pair of scores 20*a* and 20*b*. Therefore, in the pair of arcuate regions 30*a* and 30*b*, the liner 6 is non-adhesive or weakly adhesive to the inner surface of the top panel wall 8 of the shell 4, while the liner 6 is adhered to the remaining region of the inner surface of the top panel wall 8 of the shell 4.

Figure 5:
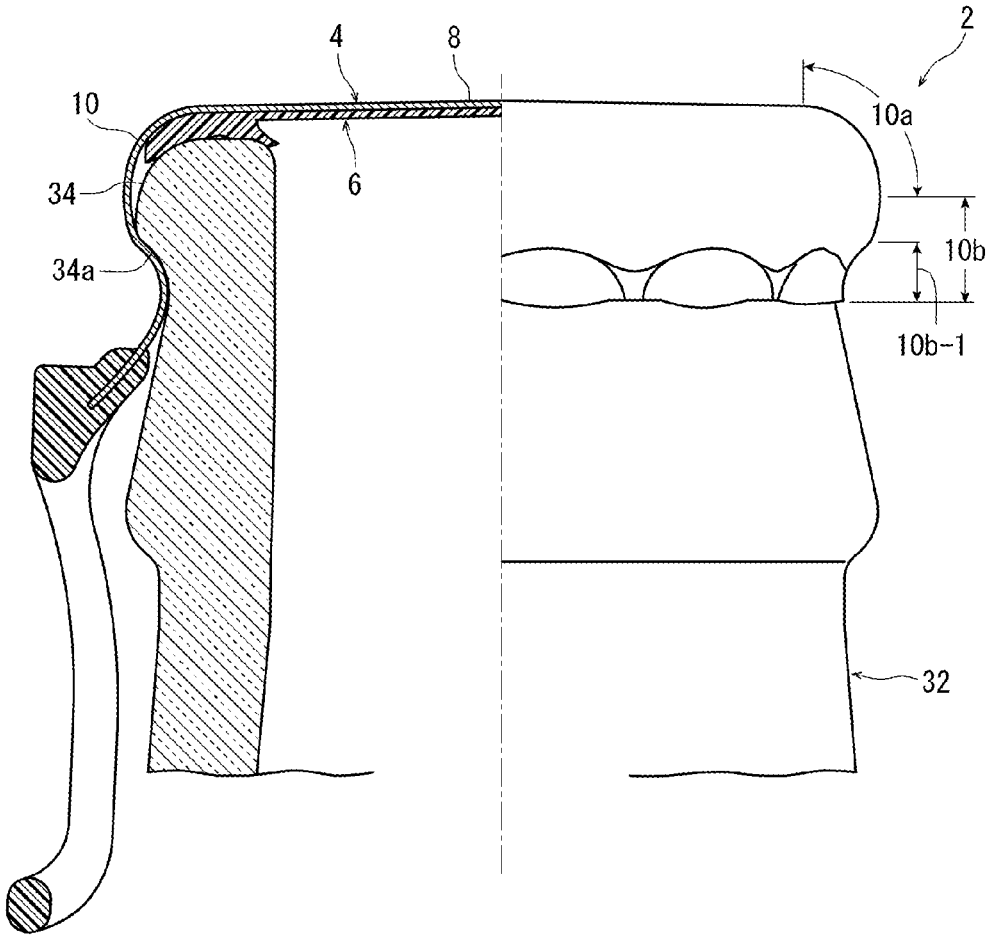
FIG. 5 is a partly cross sectional side view showing the container lid of FIG. 1, which is attached to the mouth-neck section of a container.

FIG. 5 illustrates a state where the container lid 2 is attached to the mouth-neck section 32 of the container and the mouth-neck section 32 is sealed. The container can be formed of glass, any suitable synthetic resins like polyethylene terephthalate or a sheet of a metal like aluminum-based alloy. At the outer peripheral end part of the mouth-neck section 32, an annular locking ridge 34 is formed. For attaching the container lid 2 to the mouth-neck section 32 thereby sealing the mouth-neck section 32, the container lid 2 is fitted to the mouth-neck section 32 and pressed downward to bring the internal annular ridge 26 and the external annular ridge 28 of the liner 6 into close contact with the upper end part of the mouth-neck section 32. Next, the lower part 10*b*-1 of the linear part 10*b* of the skirt wall 10 is swaged (deformed) radially inward to be locked by the lower surface 34*a* of the annular locking ridge 34 of the mouth-neck section 32. In this manner, the container lid 2 is attached to the mouth-neck section 32 of the container to seal the mouth-neck section 32.

In consuming the content accommodated within the container, the container is opened by detaching the container lid 2 from the mouth-neck section 32. In that case, the consumer hooks his finger on the ring part 18 of the shell 4 of the container lid 2 and pulls the part radially outward, and then upward. In this manner, the first portions 20*a*-1 and 20*b*-1 of the pair of scores 20*a* and 20*b* are ruptured to the vicinity of the upper end of the lower part 10*b*-1 of the linear part 10*b* of the skirt wall 10. At the same time, the ruptured site between the first portions 20*a*-1 and 20*b*-1 of the pair of scores 20*a* and 20*b* at the lower part 10*b*-1 of the linear part 10*b* of the skirt wall 10 is displaced radially outward and upward to be spaced from the annular locking ridge 34, whereby the inner pressure of the container is released suitably. At that time, the site other than the specific site between the first portions 20*a*-1 and 20*b*-1 of the ruptured pair of scores 20*a* and 20*b*, at the lower part 10*b*-1 of the linear part 10*b* of the skirt wall 10, is still locked by the lower surface 34*a* of the annular locking ridge 34 of the mouth-neck section 32. As a result, it is possible to avoid the container lid 2 from vigorously flying/dropping off. Furthermore, since the first portions 20*a*-1 and 20*b*-1 of the pair of scores 20*a* and 20*b* disposed on the lower part 10*b*-1 of the linear part 10*b* of the skirt wall 10 extend straight, they can be ruptured without applying excessive force. In contrast, in a conventional container lid, a pair of scores extend arcuately upward and circumferentially to the both sides at the lower parts of the first portions of the skirt wall as indicated with a long dashed double-short dashed line X in FIG. 3. When the score is ruptured at the lower part of the first portion of the skirt wall, the lower part of the linear part of the skirt wall is displaced radially outward and upward at the site that is circumferentially longer in comparison with the counterpart of the present invention, and the lower part is separated from the mouth-neck section. As a result, the locking force of the container lid 2 with respect to the mouth-neck section 32 will be decreased excessively, and this may cause a risk that the container lid fly/drop off vigorously. Further, in the container lid, the lower part of the first portion of the skirt wall extends arcuately toward the circumferential both side and upward. This configuration requires application of force for rupture upward and simultaneously toward the circumferentially both sides, and thus, rupture requires a relatively large force.

The ring part 18 is further displaced upward or to the diametrically opposite direction so as to further rupture the area other than the first portions 10*a*-1 and 10*b*-1 of the pair of scores 10*a* and 10*b*, and rupture the second portions 10*a*-2 and 10*b*-2. As a result, the lower part 10*b*-1 of the linear part 10*b* of the skirt wall 10 is spaced from the annular locking ridge 34 of the mouth-neck section 32 for a certain length in the circumferential direction. As a result, the lower part 10*b*-1 is detached from the mouth-neck section 32 of the container lid 2, and thus, the mouth-neck section 32 is unsealed.

Example

An aluminum-based alloy sheet having a thickness of 0.24 mm was punched out to have a shape as shown in FIG. 3, and subsequently worked as required, for instance, drawn to form a shell having a top panel wall, skirt wall, and a base part fora grip piece as shown in FIGS. 1 and 2. Next, a polypropylene ring was formed by compression on the base part of the grip piece, and a soft polyethylene liner was formed by pressing onto the inner surface of the top panel wall, whereby a container lid as shown in FIGS. 1 and 2 was produced. The outer diameter of the shell was 27.00 mm, the overall height of the skirt wall (excluding the grip piece) was 7.00 mm, the vertical length of the linear part of the skirt wall was 4.26 mm, and the vertical length of the lower part of the linear part of the skirt wall was 1.75 mm. The lower end of the external annular sealant of the liner was positioned 1.20 mm above the upper end of the linear part of the skirt wall, and the lower end of the internal annular sealant of the liner was positioned 0.90 mm above the upper end of the linear part of the skirt wall.

In the pair of scores, t1 denotes a material residual thickness at a site, specifically the site ranging from the lower end of the skirt wall of the first portions, above the upper end of the lower part of the skirt wall, and to the intermediate of the linear part other than the lower part; t2 denotes a material residual thickness at the rest of the first portions; and t3 denotes a material residual thickness at the second portions and the third portions. The thickness t1 was 180 μm, the thickness t2 was 165 μm, and the thickness t3 was 120 μm. The radius of curvature of the pair of scores at the portion located at the arcuate part of the skirt wall was 5.00 mm.

A glass container (nominal capacity: 120 ml) having a mouth-neck section as shown in FIG. 5 accommodated 120 ml of water containing 3.4 volumes of carbonic acid. At the mouth-neck section of the container, a container lid was attached as shown in FIG. 5, and the mouth-neck section was sealed. The container with the sealed mouth-neck section was left stand for three days in an environment of 50° C., and then, the container lid was detached from the mouth-neck section to unseal the mouth-neck section. As a result of conducting the same procedures for 150 containers, there was no container lid flying/dropping off at the time of detaching from the mouth-neck section.

Comparative Example

For comparison, the same experiment as that for the aforementioned Example was conducted for 150 containers, except that the shape of the first portions of the pair of scores formed on the shell was as indicated with the long dashed double-short dashed line X in FIGS. 1 and 2, the radius of curvature was 8.00 mm, the lower end of the external annular sealant of the liner was positioned 1.20 mm below the upper end of the linear part of the skirt wall, and the lower end of the internal annular sealant of the liner was positioned 0.90 mm above the upper end of the linear part of the skirt wall. As a result, the container lids of fifteen containers were flew/dropped off vigorously at the time the lids were detached from the mouth-neck sections.

EXPLANATIONS OF LETTERS OR NUMERALS

2: Container lid
4: Shell
6: Liner
8: Top panel wall
10: Skirt wall
10*a*: Arcuate part of skirt wall
10*b*: Linear part of skirt wall
10*b*-1: Lower part of linear part
12: Grip piece
14: Base part of grip piece
16*a*: Notch
16*b*: Notch
18: Ring part
20*a*: Score
20*b*: Score
20*a*-1: Score's first portion
20*b*-1: Score's first portion
20*a*-2: Score's second portion
20*b*-2: Score's second portion
20*a*-3: Score's third portion
20*b*-3: Score's third portion
22: Thin-walled centration section of liner
24: Thick-walled peripheral edge section of liner
26: Internal annular sealant
28: External annular sealant
30*a*: Arcuate region to be applied with non-adhesive or weakly adhesive paint
30*b*: Arcuate region to be applied with non-adhesive or weakly adhesive paint
32: Container's mouth-neck section
34: Annular locking part

The invention claimed is:

1. An easily openable container lid for a container that has a cylindrical mouth-neck section having an annular locking ridge formed at an upper end part of an outer peripheral surface, the cylindrical mouth-neck section is to be sealed to have a positive internal pressure after a gas-containing liquid is accommodated within the container, the container lid comprising a shell and a liner, wherein the shell comprises a flat circular top panel wall, a skirt wall having an arcuate part extending arcuately radially outward and downward from a peripheral edge of the flat circular top panel wall in a longitudinal cross sectional view and a linear part extending vertically downward to follow the arcuate part, and a grip piece extending from a lower end of the skirt wall, the flat circular top panel wall, the skirt wall and at least a base part of the grip piece are integrally formed of a metal sheet, and a pair of scores each including a first portion and a second portion are formed, where the first portions extend upward on the skirt wall from both sides of the grip piece, and the second portions extend arcuately between an upper end part of the skirt wall and a peripheral edge part of the flat circular top panel wall, the liner, which is disc-shaped and made of a synthetic resin, is disposed on an inner surface of the flat circular top panel wall of the shell, the container lid is attached to the cylindrical mouth-neck section by swaging a lower part of the linear part of the skirt wall radially inward below the annular locking ridge of the cylindrical mouth-neck section, the respective first portions of the pair of scores extend straight and vertically from the lower end of the skirt wall to a site above an upper end of the lower part of the linear part, and $t1>t2>t3$, wherein t1 denotes a material residual thickness of the pair of scores at a site of the first portions, ranging from the lower end of the skirt wall of the first portions, above the upper end of the lower part of the linear part of the skirt wall and to an intermediate part of the linear part other than the lower part, t2 denotes a material residual thickness of the pair of scores at a remainder of the first portions, and t3 denotes a material residual thickness of the pair of scores at the second portions and at third portions.

2. The easily openable container lid according to claim 1, wherein t1 is 170 to 190 μm, t2 is 155 to 175 μm, and t3 is 110 to 130 μm.

3. The easily openable container lid according to claim 2, wherein the respective first portions of the pair of scores extend straight to the upper end of the linear part of the skirt wall, and extend upward and arcuately to a direction to be circumferentially spaced from each other at the arcuate part of the skirt wall.

4. The easily openable container lid according to claim 3, wherein the liner is non-adhesive or weakly adhesive to the shell in a pair of arcuate regions extending along the pair of scores and covering the pair of scores while the liner is adhered to the shell in regions other than the pair of arcuate regions.

5. The easily openable container lid according to claim 4, wherein the liner has a thin-walled centration section and a thick-walled peripheral edge section, the thick-walled peripheral edge section has a lower surface on which an internal annular sealant and an external annular sealant both extending concentrically downward are formed, and a lower end of the external annular sealant is positioned above an upper end of the linear part of the skirt wall.

6. The easily openable container lid according to claim 3, wherein the liner has a thin-walled centration section and a thick-walled peripheral edge section, the thick-walled peripheral edge section has a lower surface on which an internal annular sealant and an external annular sealant both extending concentrically downward are formed, and a lower end of the external annular sealant is positioned above an upper end of the linear part of the skirt wall.

7. The easily openable container lid according to claim 2, wherein the liner is non-adhesive or weakly adhesive to the shell in a pair of arcuate regions extending along the pair of scores and covering the pair of scores while the liner is adhered to the shell in regions other than the pair of arcuate regions.

8. The easily openable container lid according to claim 7, wherein the liner has a thin-walled centration section and a thick-walled peripheral edge section, the thick-walled peripheral edge section has a lower surface on which an internal annular sealant and an external annular sealant both extending concentrically downward are formed, and a lower end of the external annular sealant is positioned above an upper end of the linear part of the skirt wall.

9. The easily openable container lid according to claim 2, wherein the liner has a thin-walled centration section and a thick-walled peripheral edge section, the thick-walled peripheral edge section has a lower surface on which an internal annular sealant and an external annular sealant both extending concentrically downward are formed, and a lower end of the external annular sealant is positioned above an upper end of the linear part of the skirt wall.

10. The easily openable container lid according to claim 1, wherein the respective first portions of the pair of scores extend straight to the upper end of the linear part of the skirt wall, and extend upward and arcuately to a direction to be circumferentially spaced from each other at the arcuate part of the skirt wall.

11. The easily openable container lid according to claim 10, wherein the liner is non-adhesive or weakly adhesive to the shell in a pair of arcuate regions extending along the pair of scores and covering the pair of scores while the liner is adhered to the shell in regions other than the pair of arcuate regions.

12. The easily openable container lid according to claim 11, wherein the liner has a thin-walled centration section and a thick-walled peripheral edge section, the thick-walled peripheral edge section has a lower surface on which an internal annular sealant and an external annular sealant both extending concentrically downward are formed, and a lower end of the external annular sealant is positioned above an upper end of the linear part of the skirt wall.

13. The easily openable container lid according to claim 10, wherein the liner has a thin-walled centration section and a thick-walled peripheral edge section, the thick-walled peripheral edge section has a lower surface on which an internal annular sealant and an external annular sealant both extending concentrically downward are formed, and a lower end of the external annular sealant is positioned above an upper end of the linear part of the skirt wall.

14. The easily openable container lid according to claim 1, wherein the liner is non-adhesive or weakly adhesive to the shell in a pair of arcuate regions extending along the pair of scores and covering the pair of scores while the liner is adhered to the shell in regions other than the pair of arcuate regions.

15. The easily openable container lid according to claim 14, wherein the liner has a thin-walled centration section and a thick-walled peripheral edge section, the thick-walled peripheral edge section has a lower surface on which an internal annular sealant and an external annular sealant both extending concentrically downward are formed, and a lower end of the external annular sealant is positioned above an upper end of the linear part of the skirt wall.

16. The easily openable container lid according to claim 1, wherein the liner has a thin-walled centration section and a thick-walled peripheral edge section, the thick-walled peripheral edge section has a lower surface on which an internal annular sealant and an external annular sealant both extending concentrically downward are formed, and a lower end of the external annular sealant is positioned above an upper end of the linear part of the skirt wall.

17. The easily openable container lid according to claim 16, wherein the lower end of the external annular sealant is positioned as high as a vertically intermediate site of the arcuate part of the skirt wall.

18. The easily openable container lid according to claim 17, wherein a lower end of the internal annular sealant is positioned below the lower end of the external annular sealant and above the upper end of the linear part of the skirt wall.

19. The easily openable container lid according to claim 16, wherein a lower end of the internal annular sealant is positioned below the lower end of the external annular sealant and above the upper end of the linear part of the skirt wall.

* * * * *